US010843034B2

(12) United States Patent
Griggs

(10) Patent No.: US 10,843,034 B2
(45) Date of Patent: Nov. 24, 2020

(54) ABDOMINAL MUSCLE EXERCISING APPARATUS

(71) Applicant: Ryan Griggs, Clinton Township, MI (US)

(72) Inventor: Ryan Griggs, Clinton Township, MI (US)

( * ) Notice: Subject to any disclaimer, the term of this patent is extended or adjusted under 35 U.S.C. 154(b) by 0 days.

(21) Appl. No.: 16/162,894

(22) Filed: Oct. 17, 2018

(65) Prior Publication Data

US 2020/0121980 A1 Apr. 23, 2020

(51) Int. Cl.
*A63B 21/00* (2006.01)
*A63B 23/02* (2006.01)

(52) U.S. Cl.
CPC ..... *A63B 21/4037* (2015.10); *A63B 21/4034* (2015.10); *A63B 21/4035* (2015.10); *A63B 23/0211* (2013.01); *A63B 23/0216* (2013.01); *A63B 2210/50* (2013.01)

(58) Field of Classification Search
CPC ..... A63B 21/4307; A63B 21/4035; A63B 21/4034; A63B 21/4011–4015; A63B 21/4033–4035; A63B 21/4017–4021; A63B 21/4039; A63B 23/0211; A63B 23/0216; A63B 23/0205; A63B 23/047; A63B 2210/50; A63B 2208/0242; A63B 2208/0252; A63B 2208/0247; A63B 2208/0257; A63B 2208/0261; A63B 2208/0266; A63B 6/00; A61H 39/00; A61H 39/02; A61H 39/04; A61H 2201/0119; A61H 2201/0138; A61H 2201/0142; A61H 2201/0146; A61H 2201/0149; A47G 27/02; A47G 27/0206; A47G 27/0212; A47G 27/0237; A47G 9/06; A47G 9/062; A63H 33/00; A63H 33/006; A63H 33/008
USPC ..... 446/227; 297/397, 423.39, 423.41
See application file for complete search history.

(56) References Cited

U.S. PATENT DOCUMENTS

| | | | | | |
|---|---|---|---|---|---|
| 1,222,563 | A * | 4/1917 | Rosenberg | A47G 9/062 | 5/419 |
| 1,256,783 | A * | 2/1918 | Fuller | A47G 9/062 | 5/419 |
| 2,264,046 | A * | 11/1941 | McClellan | A63B 23/0211 | 482/145 |
| 5,100,130 | A * | 3/1992 | Shoebrooks | A63B 21/4039 | 482/121 |
| 5,417,636 | A * | 5/1995 | Havens | A63B 21/0552 | 482/140 |
| 7,207,932 | B1 * | 4/2007 | Dean | A63B 23/0211 | 482/140 |
| 9,278,252 | B1 * | 3/2016 | Will | A63B 23/0222 | |
| 10,315,065 | B1 * | 6/2019 | Soba | A63B 21/4035 | |
| 10,383,548 | B2 * | 8/2019 | Brandon | A63B 21/00196 | |
| 2006/0223683 | A1 * | 10/2006 | Orona | A63B 21/04 | 482/96 |

(Continued)

*Primary Examiner* — Megan Anderson
*Assistant Examiner* — Kathleen Vermillera
(74) *Attorney, Agent, or Firm* — Thomas J. Nikolai; DeWitt LLP

(57) ABSTRACT

Improved exercise techniques in a more sanitary environment are achieved by providing a personal exercise mat that lays flat when used, can be easily cleaned between uses, and is easily stored and transported. The mat is adapted to be detachably coupled to handholds and footholds that are employed when the mat is in use and stored separately from the mat in a single carrying case with the mat.

18 Claims, 5 Drawing Sheets

(56) References Cited

U.S. PATENT DOCUMENTS

| | | | | |
|---|---|---|---|---|
| 2008/0293553 | A1* | 11/2008 | Hanspall | A63B 23/0211<br>482/140 |
| 2010/0197471 | A1* | 8/2010 | Hayes | A63B 6/00<br>482/140 |
| 2010/0273617 | A1* | 10/2010 | Mills | A63B 23/0211<br>482/140 |
| 2010/0299833 | A1* | 12/2010 | Kessler | A63B 21/4037<br>5/417 |
| 2013/0324382 | A1* | 12/2013 | Wilson | A61H 7/007<br>482/142 |
| 2016/0016029 | A1* | 1/2016 | Savioli | A63B 21/16<br>482/92 |
| 2017/0266485 | A1* | 9/2017 | Willis | A63B 21/4037 |
| 2018/0133535 | A1* | 5/2018 | Derry | A63B 21/0442 |

* cited by examiner

ABDOMINAL MUSCLE EXERCISING APPARATUS

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

This invention relates to exercise equipment. More specifically, this invention relates to exercise equipment that may be used when performing abdominal exercises.

II. Description of the Prior Art

A variety of exercises are used in physical education classes and personal training sessions to strengthen and tone the abdominal muscles. One common example is "sit-ups". When performing sit-ups, a person lays on a floor (or the ground) and repeatedly transitions from a prone position to a seated position while the feet are held to the floor by a trainer or some other person.

Several problems are presented when performing such abdominal exercises. First, such abdominal exercises typically require the assistance of another person. Second, the floors on which such exercises are performed are not always clean and germ-free. This is particularly true in heavily-used health clubs and gymnasiums where many people walk across the floor and exercise on the floor leaving behind body fluids in the form of perspiration. When the floors are carpeted, there is no efficient and effective way to remove the germs left behind by people exercising. A year or more may go by between carpet cleanings. Floors with hard surface coverings such as tile or wood may be swept daily. However, they are not always routinely treated with a disinfectant to kill germs deposited on the floor by people as they exercise. Such germs can lead to the spread of fungal infections such as ringworm, and a variety of staph, strep and other bacterial infections, one example being impetigo.

Further, exercising on a floor is unnecessarily uncomfortable and in ways that inhibit and adversely affect the benefits derived from regular and sufficient abdominal exercising. Performing abdominal exercises directly on the floor or ground on a routine basis is also bad for the tail bone and spine and can lead to chronic back pain.

While some gyms, schools, and clubs offer mats that can be used to lessen discomfort, these mats suffer from the issues discussed above. These mats also are not always designed to promote proper exercise technique which can reduce the level of discomfort while performing abdominal exercises. For example, people doing sit-ups often engage their hip flexors rather than primarily engaging their abdominal muscles which are intended to be the focus of the exercise. This often causes lower back pain resulting in people limiting their exercise routine, or even excluding abdominal exercises all together from that routine.

Thus, there is a real need for a safe and effective abdominal exercise device that solves each of the foregoing problems.

SUMMARY OF THE INVENTION

The present invention is directed to personal abdominal exercise equipment. In one example, the equipment comprises a mat having a main body section. The main body section comprises a lower layer produced from a plurality of braided cords. A cushion is attached to the lower layer.

The mat also includes a head section extending from the first end of the main body section. The head section includes a first base made of a hard, yet flexible plastic material and a pillow coupled to the first base. Extending from an opposing second end of the main body section is a foot section. The foot section has a second base made of a hard yet flexible plastic material. Mats made as described above are adapted to be rolled into a coil for storage and transport and unrolled so that they can lay flat on a floor.

In addition to the mat, the personal abdominal exercise apparatus includes a pair of handholds adapted to be detachably coupled to the first base of the head section on opposite sides of the pillow. As such, when a user lies on the mat, the user's head is supported by the pillow and a person can raise his or her hands so that they are adjacent the head and grip the handholds. The exercise apparatus further comprises a pair of footholds adapted to be detachably coupled to the second base of the foot section. A person using the device is able to insert his or her feet into these footholds to secure the feet to the mat.

Personal exercise equipment conforming to the present invention may also include a variety of additional features. For example, the upper cushion of the main body section of the mat and the pillow secured to the head section may each comprise a gel material. This gel material may be a silicone gel.

The handholds and the footholds are detachably coupled to the head sections and foot sections of the mat. In various embodiments, this feature results from the first base of the head section having a top surface and each handhold having a third base comprising a bottom surface. The bottom surface of the third base of each handhold is in face-to-face registration with the top surface of the first base when the handholds are attached to the mat. The top surface of the first base of the head section may have a first pair of keyhole slots projecting inwardly from the top surface adjacent the pillow on a first side of the pillow and a second pair of identical keyhole slots projecting inwardly on the opposite side of the pillow. The bottom surface of the third base of each handhold may be provided with a pair of projections adapted to be coupled to the keyhole slots on a side of the pillow to detachably couple to the handholds to the mat.

In a similar fashion, the footholds may be attached to the mat. More specifically, the second base of the foot section of the mat has a top surface and each foothold has a fourth base having a bottom surface. When the footholds are attached to the mat, the bottom surface of the fourth base of each foothold is in face-to-face registration with the top surface of the second base of the foot section. Again, two pairs of keyhole slots may project inwardly from the top surface of the second base of the foot section and each foothold may be provided with a pair of projections adapted to be coupled to one of these pairs of keyhole slots to detachably couple to the footholds to the mat.

Each handhold comprises a gripping member extending upwardly from the third base of the handhold. In certain embodiments, the gripping member has two legs which cooperate with the third base of the gripping member to form an open triangular shape. The opening of the open triangular shape is adapted to receive a portion of a hand of the user.

Further, the handhold may comprise finger recesses which interact separately with the fingers of a user as the user grips the handhold.

The footholds are typically slipper-shaped such that users can easily slide their feet into the footholds. One will be adapted to receive the right foot of a user and the other will be adapted to receive the left foot of a user. The footholds may comprises a gel material such as a silicon gel so that they fit comfortably about the user's foot while at the same time grip the foot tightly so the foot does not become inadvertently dislodged from a foothold during exercise.

For added comfort, the pillow may be provided with two sections, a first section for supporting the head and a second section for supporting the neck of a user during exercise.

The abdominal exercise apparatus of the present invention is personal in the sense that it is intended to be used by a single individual such that germs are not spread by the mat between a plurality of users.

To make it easy for a user to transport the exercise apparatus, a carrying case may also be provided. This carrying case typically will include a first chamber adapted to receive the rolled-up mat when it is not in use and a second chamber adapted to receive and contain the handholds and the footholds which have been removed from the mat prior to rolling the mat up. The carrying case may also be adapted to hold cleaning supplies such as a rag and a supply of disinfectant that can be used to treat the mat and kill any germs on the mat between each use. The carrying case will typically have a handle. The handle may be in the form of a shoulder strap. The carrying case will also include covers to close the chambers and secure the mat, the footholds and the handholds in the carrying case.

The dimensions of the apparatus will, of course, vary based upon the height of a user. However, for most users, a mat that is between 10 and 20 inches wide and in the range of 4½ feet to 5½ feet long will suffice. The main body section of the mat comprises about ⅗ of its overall length while the foot and head sections represent the remainder of the length. The braided cords of the main body section may be interwoven. Such cords can be made of natural rubber or any other suitable elastic material.

BRIEF DESCRIPTION OF THE DRAWINGS

The foregoing features, objects and advantages of the invention will become apparent to those skilled in the art from the following detailed description and with reference to the following drawings in which like numerals in the several views refer to corresponding parts.

DETAILED DESCRIPTION

Figure 1:
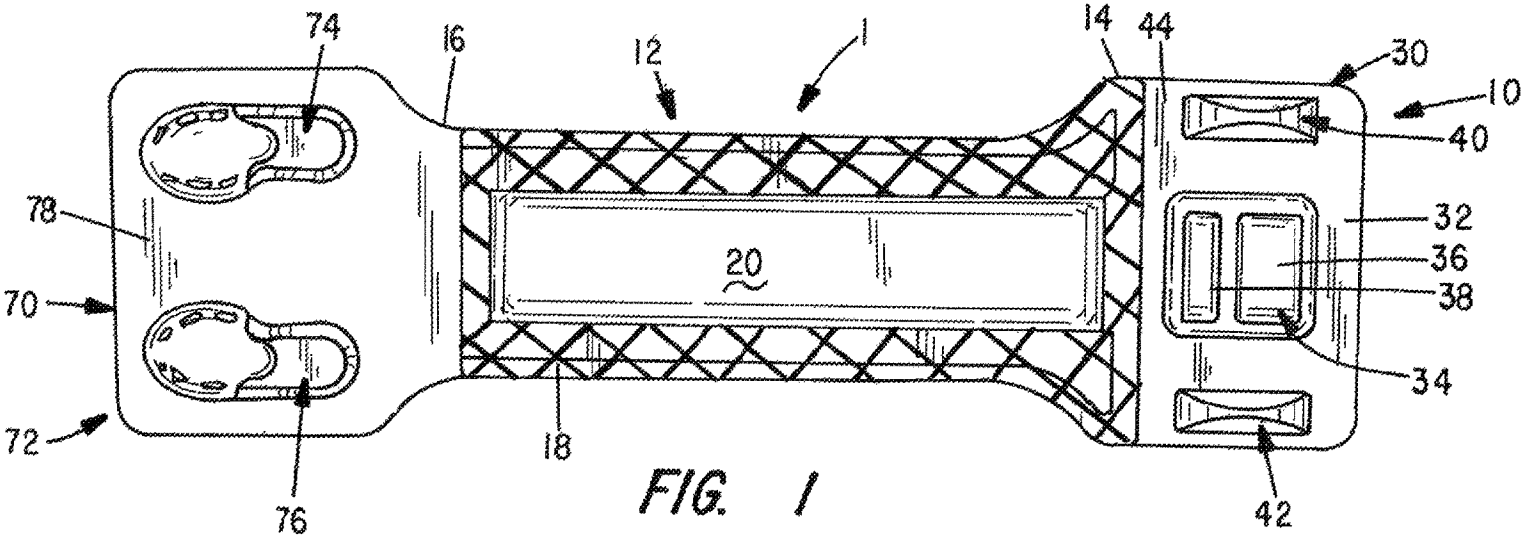
FIG. 1 is a top plan view of an exercise apparatus made in accordance with the present invention.

In the following detailed description, reference is made to various exemplary embodiments in which the invention may be practiced. These embodiments are described with sufficient detail to enable those skilled in the art to practice the invention, and it is understood that other embodiments may be employed, and that structural and other changes may be made without departing from the spirit or scope of the present invention.

This description of the preferred embodiment is intended to be read in connection with the accompanying drawings, which are to be considered part of the entire written description of this invention. In the description, relative terms such as "lower", "upper", "horizontal", "vertical", "above", "below", "up", "down", "top" and "bottom", "under", as well as derivatives thereof (e.g., "horizontally", "downwardly", "upwardly", "underside", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "joined", and "joining" are used interchangeably and refer to one structure or surface being secured to another structure or surface or integrally fabricated in one piece unless expressly described otherwise.

An exercise apparatus 1 made in conformance with the present invention is illustrated in the drawings. As shown the exercise apparatus comprises a mat 10 having a main body section 12 having opposed first and second ends 14/16. The mat comprises a lower layer 18 produced from a plurality of braided cords which may be woven into a mesh. A cushion 20 is attached to layer 18.

The mat 10 further comprises a head section 30 extends from the first end 14 of the main body member. The head section 30 includes a first base 32 and a pillow 34 coupled to the first base 32. The pillow may be divided into a first section 36 adapted to support the head of a user and second section 38 adapted to support the neck of a user. The first base 32 of the head section 30 should be preferably made of a hard, yet flexible plastic material. The pillow 34 may be made of a gel material such as a silicone gel.

Figure 2:
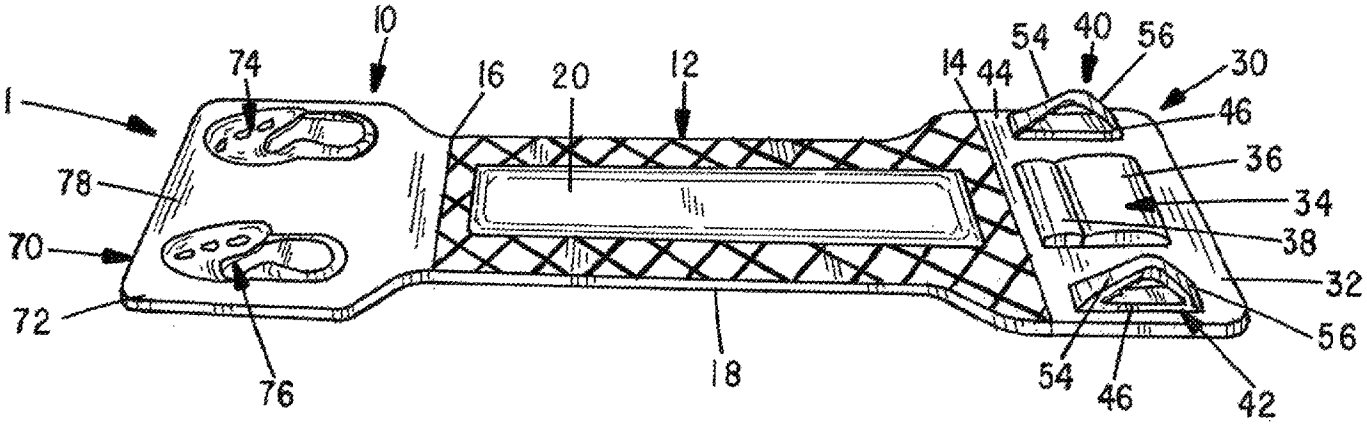
FIG. 2 is a perspective view of the exercise apparatus of FIG. 1.
Figure 3:
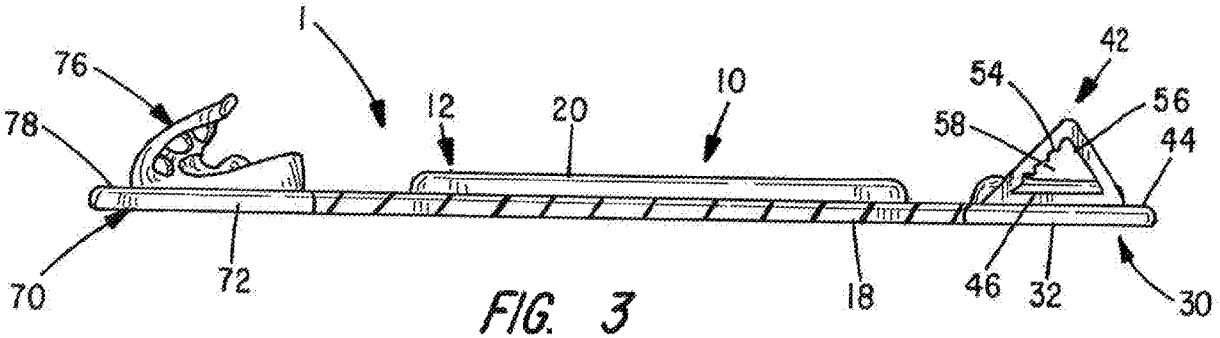
FIG. 3 is a side view of the exercise apparatus of FIG. 1.

Extending from the second end 16 of the mat 10 is a foot section 70. The foot section 70 also has a base (the second base) 72. Like base 32, base 72 is made of a hard, yet flexible plastic material. The mat 10 is adapted to be rolled into a coil for storage and transport as shown, for example, in FIG. 7 and is further adapted to be unrolled so that the mat 10 lays flat on a floor as shown in FIGS. 1-3.

The exercise apparatus shown in the drawings further includes a pair of handholds. The handholds 40 and 42 are adapted to be attachably coupled to the first base 32 of the head section 30 on opposite sides of the pillow 34. The first base 32 has a top surface 44. Each handhold has a third base 46 having a bottom surface 47. The bottom surface 47 of each handhold 40/42 is in face-to-face registration with the top surface 44 of the first base member 32 when the handholds are attached to the mat.

Figure 5:
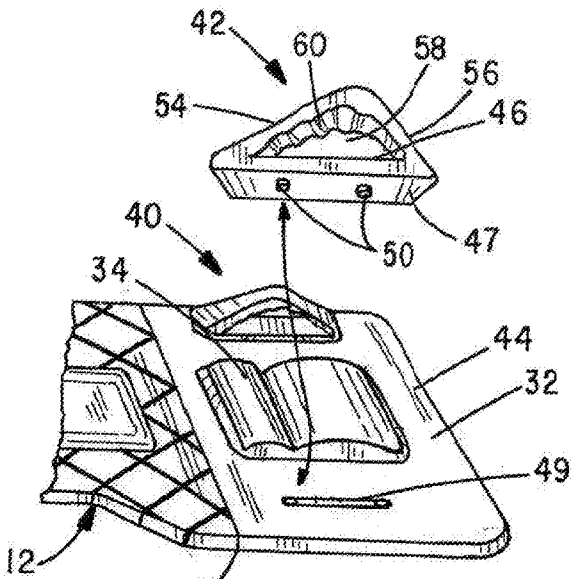
FIG. 5 is a partial perspective view illustrating how the handholds of the exercise apparatus of FIG. 1 are held in place.
Figure 10:
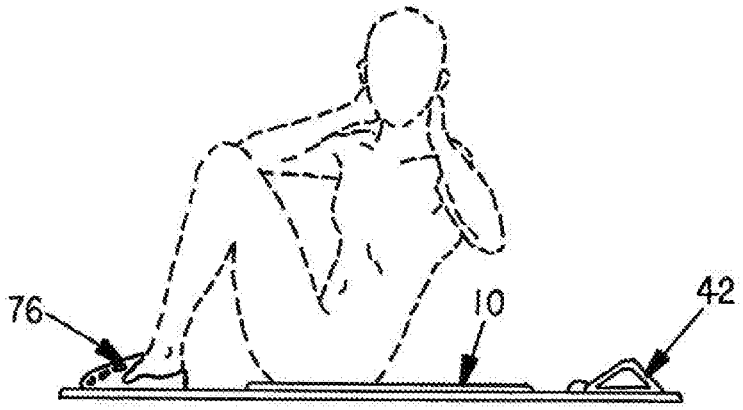
Figure 12:
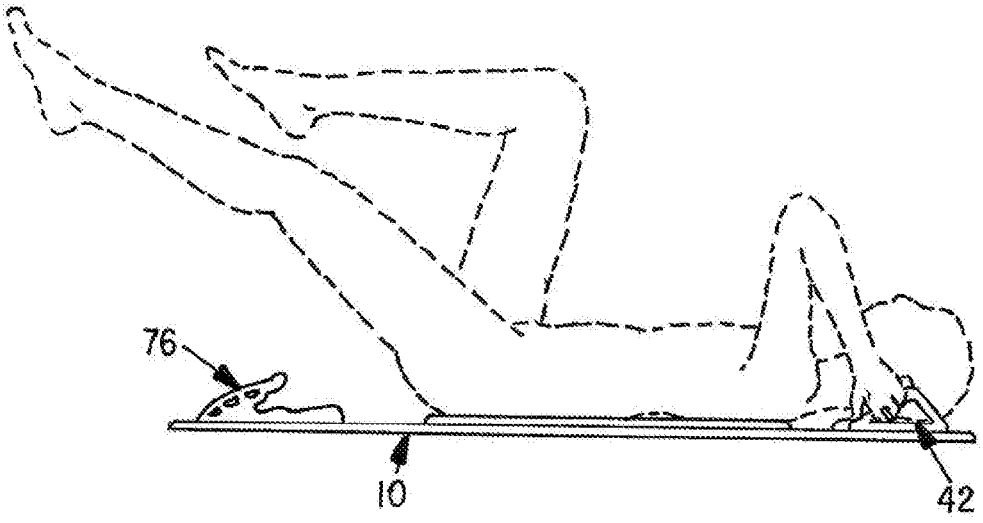
FIG. 12 illustrates a way in which the exercise apparatus of the present invention can be employed when performing leg lift exercises to exercise the abdominal muscles.

As best shown in FIG. 5, this attachment is made by providing keyhole slots 49 extending inwardly from the top surface 44 of the base member 32 on either side of the pillow 34. These slots mate with projections 50 projecting from the bottom surface of the handhold to detachably secure the handholds to the mat. Each handhold 40 comprises a gripping member extending upwardly from the third base 46. The gripping member comprises two legs 54 and 56 which, together with the base 46, form an open triangle. More specifically, the triangle has an opening 58 which, as shown in FIGS. 10 and 12, is adapted to receive one of the hands of a user. The gripping member may also include finger slots 60 to receive the individual fingers of the user as the user grips the handhold.

Figure 4:
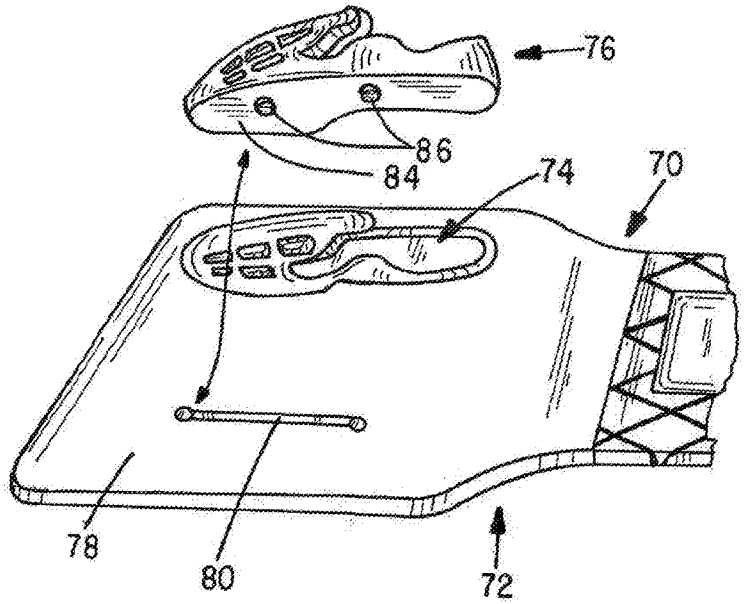
FIG. 4 is a perspective view illustrating how the footholds of the exercise apparatus of FIG. 1 are detachably secured in place.

As noted above, a foot section 70 extends from end 16 of the main body section 10. The foot section 70 has a base 72 and a pair of footholds 74/76 adapted to be detachably coupled to the second base 72 of the foot section 70. As shown in FIG. 4, the footholds 74 and 76 are slipper-shaped. These footholds 74/76 may be made out of a gel material such as silicone gel. The foothold 74 is adapted to receive the right foot of a user. The foothold 76 is adapted to receive the left foot of a user. The gel material makes the footholds comfortable and has some elastic properties that cause the footholds to securely hold the foot within the footholds.

The footholds 74 and 76 are detachably coupled to the foot section 70 in a manner like the way the handholds were attached to the head section. More specifically, the base 72 of the foot section 70 has a top surface 78. Extending inwardly from the top surface 78 are two pairs of keyhole slots, one for each of the pair of footholds 74/76. In FIG. 4, the pair of keyhole 80 slots used to couple foothold 76 to the base 72 is shown. Each foothold has a base 84 and a pair of projections 86 which mate with the keyhole slots 80 to secure the footholds 74 and 76 to the mat 10.

Figure 6:
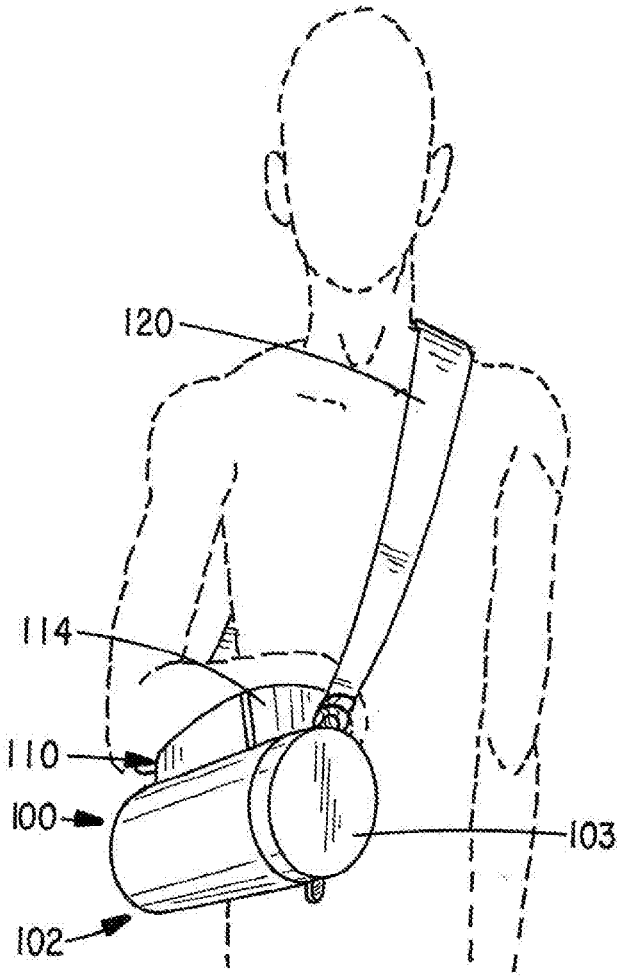
FIG. 6 is shows how a carrying case of the present invention may be held by a user.
Figure 7:
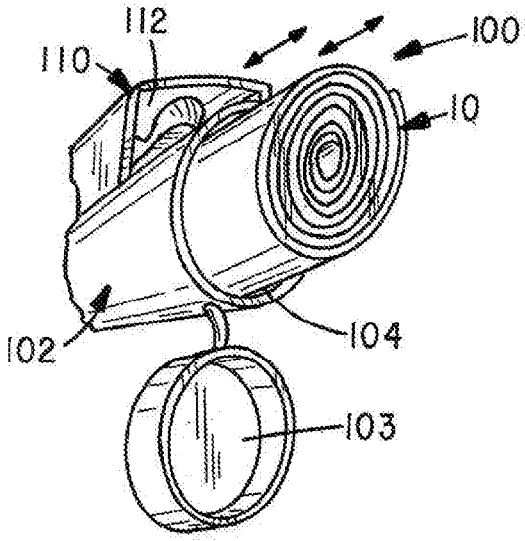
FIG. 7 illustrates how the mat of the embodiment of FIG. 1 can be rolled into a coil and inserted into the carrying case of FIG. 6.
Figure 8:
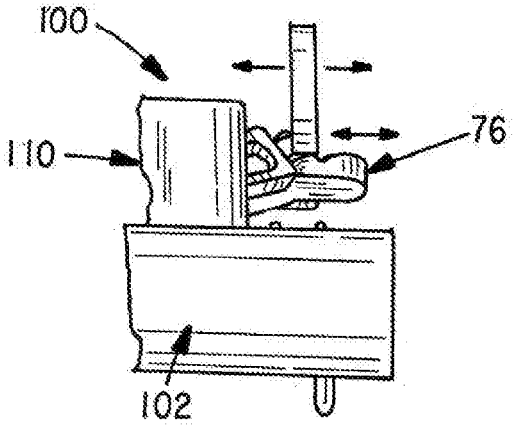
FIG. 8 illustrates how the handholds and footholds can be inserted into a second chamber of the carrying case of FIG. 6.

FIGS. 6-8 show a carrying case 100 that may be used to store and transport the components discussed above. Specifically, and as previously noted, with the handholds 40 and 42 and the footholds 74 and 76 removed from the mat 10, the mat 10 can be rolled up into a coil. The carrying case 100 has a first compartment 102 adapted to receive and store the rolled-up mat 10. This compartment has an opening 104 through which the mat 10 can be inserted into or withdrawn from the carrying case 100. A cover 103 is provided to close this opening 104.

The carrying case 100 also has a second chamber 110, the compartment 110 is used to store at least the footholds 74 and 76 and the handholds 40 and 42. Ideally, this compartment 110 will also be large enough to store cleaning supplies such as a bottle of disinfectant and a rag for applying the disinfectant between each use to the mat, the footholds and handholds. A cover 114 is used to seal opening 112 of compartment 110 and the contents within the compartment 110. The carrying case 100 may also be provided with a handle 120. As illustrated in FIG. 6, the handle 120 is in the form of a shoulder strap. Other forms of handles may be used without deviating from the invention.

Figure 9:
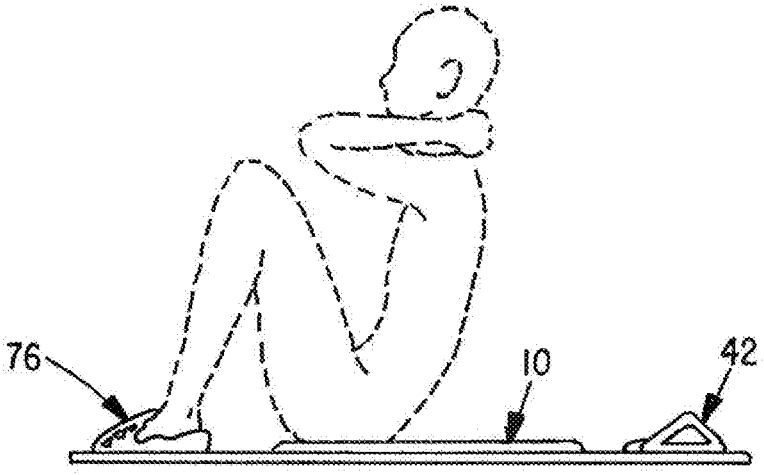
FIGS. 9-11 illustrate various ways that the exercise apparatus of the present invention can be employed when performing sit-ups to exercise the abdominal muscles.
Figure 11:
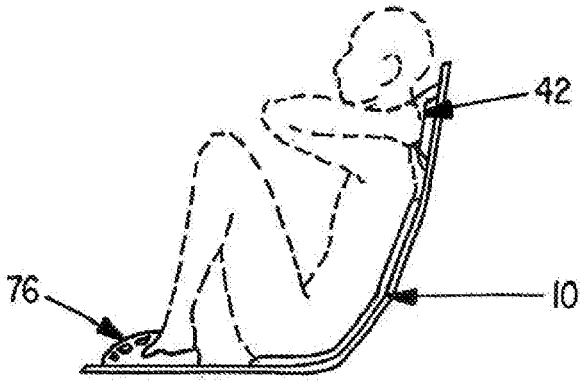

FIGS. 9-12 show several ways in which the exercise apparatus of the present invention can be used to exercise the abdominal muscles. As shown in FIG. 9, a person is performing sit-up exercises. The mat 10 is placed on the floor or ground. The person is supported by the mat 10 above the floor or ground. The person's tail bone and spine are offered considerable protection by the main body section 12, and more specifically lower layer 18 and cushion 20, to reduce discomfort and the risk of injury to the tail bone and spine. The person's feet are restrained by the mat 10 and the footholds 74/76. In FIG. 9, the handholds 40/42 are not being used, instead the person has placed his/her hands behind the neck. FIG. 10 shows the same person in FIG. 9 doing sit-ups but adding an abdominal twist as the person rises from the mat. Again, the user has placed the feet in the foothold 74/76 and is not using the handholds 40/42. FIG. 11 shows an alternative exercise in which the handholds 40/42 are employed. Specifically, the user is performing sit-ups with the user's feet within the footholds 74/76 and the user is gripping the handholds 40/42 such that the arms pulling on the handholds assist the user in performing the exercise.

FIG. 12 shows still another exercise that may be performed. In this exercise, the user is gripping the handholds 40/42 as the user performs leg-lifting exercises. With this exercise, the footholds 74/76 are not being used.

FIGS. 9-12 represent just some of the exercises that may be employed using the present invention.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A personal abdominal exercise apparatus comprising:

(a) a mat having a main body section having opposing first and second ends and comprising a lower layer produced from a plurality of braided cords and an upper cushion attached to the lower layer, a head section extending from the first end of the main body section and having a first base and a pillow coupled to the first base, a foot section extending from the second end of the main body section and having a second base, wherein said mat is adapted to be rolled into a coil for storage and transport and unrolled so that the mat lays flat on a floor;

(b) a pair of handholds adapted to be detachably coupled to the first base of the head section on opposite sides of the pillow; and (c) a pair of footholds adapted to be detachably coupled to the second base of the foot section.

2. The personal abdominal exercise apparatus of claim 1 further comprising a carrying case having a housing with a first chamber adapted to receive the mat after the mat has been rolled into the coil, and a second chamber adapted to receive the pair of handholds and the pair of footholds.

3. The personal abdominal exercise apparatus of claim 2 wherein the carrying case further comprises a handle.

4. The personal abdominal exercise apparatus of claim 3 wherein said handle is in the form of a shoulder strap.

5. The personal abdominal exercise apparatus of claim 2 wherein said carrying case is further adapted to carry cleaning supplies for cleaning the personal abdominal exercise apparatus after each use.

6. The personal abdominal exercise apparatus of claim 1 wherein said upper cushion and pillow each comprise a gel material.

7. The personal abdominal exercise apparatus of claim 6 wherein said gel material of each of the upper cushion and pillow is a silicone gel.

8. The personal abdominal exercise apparatus of claim 1 wherein the first base has a top surface, and each handhold of the pair of handholds has a third base having a bottom surface in face-to-face registration with the top surface of the first base when each handhold of the pair of handholds are attached to the first base, each handhold of the pair of handholds further comprising a gripping member extending upwardly from the third base.

9. The personal abdominal exercise apparatus of claim 8 wherein said first base has a first pair of keyhole slots projecting inwardly from the top surface adjacent the pillow on a first side of the pillow and a second pair of keyhole slots projecting inwardly from the top surface adjacent the pillow on a second side of the pillow, and wherein the bottom surface of the third base of each handhold of the pair of handholds has a pair of projections adapted to be coupled to either the first or second pair of keyhole slots on the first or second side of the pillow, respectively, to detachably couple the pair of handholds to the mat.

10. The personal abdominal exercise apparatus of claim 1 wherein said pair of footholds comprise a gel material.

11. The personal abdominal exercise apparatus of claim 10 wherein the gel material of the pair of footholds is a silicone gel.

12. The personal abdominal exercise apparatus of claim 1 wherein said plurality of braided cords comprise an elastic material.

13. The personal abdominal exercise apparatus of claim 12 wherein said elastic material comprises natural rubber.

14. The personal abdominal exercise apparatus of claim 1 wherein the second base has a top surface, and each foothold of the pair of footholds has a third base having a bottom surface in face-to-face registration with the top surface of the second base when each foothold of the pair of footholds is attached to the second base, said pair of footholds being slipper shaped, wherein a first foothold of the pair of footholds is adapted to receive a right foot of a user and the other foothold of the pair of footholds is adapted to receive a left foot of the user.

15. The personal abdominal exercise apparatus of claim 1 wherein said plurality of braided cords are interwoven to form a mesh.

16. The personal abdominal exercise apparatus of claim 1 wherein said pair of handholds comprise finger recesses.

17. The personal abdominal exercise apparatus of claim 1 wherein said pillow has a first portion adapted to support a head of a user and a second portion adapted to support a neck of the user.

18. The personal abdominal exercise apparatus of claim 1 wherein the main body section is between 10 and 20 inches wide.

* * * * *